United States Patent [19]

Newman

[11] 3,982,360

[45] Sept. 28, 1976

[54] MOBILE HOME ROOF APPARATUS

[76] Inventor: Ernest L. Newman, Box 139, R.F.D. No. 2, Owego, N.Y. 13827

[22] Filed: Apr. 7, 1975

[21] Appl. No.: 565,527

Related U.S. Application Data

[63] Continuation of Ser. No. 452,753, March 20, 1974, abandoned.

[52] U.S. Cl. ..... 52/22; 52/90

[51] Int. Cl.[2] ..... E04B 7/00; E04B 7/04

[58] Field of Search ..... 52/11, 22, 23, 74, 90, 52/300, 301; 135/5 A; 403/187, 189, 231, 289, 292, 401, 402, 403, 406

[56] References Cited

UNITED STATES PATENTS

| | | | |
|---|---|---|---|
| 326,056 | 9/1885 | Overman | 52/90 |
| 2,306,537 | 12/1942 | Hamm | 52/23 |
| 2,463,183 | 3/1949 | Kleinhans | 52/90 |
| 2,485,473 | 10/1949 | Bishop | 135/5 A |
| 2,602,406 | 7/1952 | Orter | 52/22 |
| 2,722,901 | 11/1955 | Johnson | 52/90 |
| 2,948,288 | 8/1960 | Nelson | 135/5 A |
| 3,106,270 | 10/1963 | Lichty | 52/301 |
| 3,113,434 | 12/1963 | Phillips | 52/90 |
| 3,170,266 | 2/1965 | Roberts | 52/11 |
| 3,170,545 | 2/1965 | Toti | 52/301 |
| 3,288,516 | 11/1966 | Lewis | 52/74 |
| 3,323,268 | 6/1967 | Johnson | 52/483 |
| 3,478,474 | 11/1969 | Johansson | 52/90 |
| 3,545,144 | 12/1970 | Sickler | 52/11 |
| 3,671,062 | 6/1972 | Ashworth | 403/292 |
| 3,727,354 | 4/1973 | Powell | 52/90 |
| 3,769,764 | 11/1973 | Young | 52/23 |
| 3,824,749 | 7/1974 | Scherf | 52/11 |

FOREIGN PATENTS OR APPLICATIONS

| | | | |
|---|---|---|---|
| 291,041 | 6/1965 | Netherlands | 52/90 |
| 1,097,452 | 1/1968 | United Kingdom | 52/22 |

*Primary Examiner*—Price C. Faw, Jr.
*Assistant Examiner*—William Randolph
*Attorney, Agent, or Firm*—Richard G. Stephens

[57] ABSTRACT

A removable added roof structure for a mobile home comprises a first pair of strips permanently mounted to extend along the sides of the existing mobile home near the roof line, a plurality of pairs of vertical posts spaced across from each other extending upwardly from the strips to support a pair of longitudinal stringer members above the existing roof and to support lateral brackets extending between each pair of the posts, with further vertical posts extending upwardly from near the centerline of the mobile home to support a pair of ridgepole extrusion strips, with aluminum roof panels extending from the ridgepole extrusion strips beyond the longitudinal stringer members to carry eavestrough members attached to the roof panels and connected to the first pair of strips by brackets between which a perforated sheet material extends.

9 Claims, 13 Drawing Figures

MOBILE HOME ROOF APPARATUS

This application is a continuation of my prior copending application Ser. No. 452,753 filed Mar. 20, 1974 now abandoned.

My invention relates to mobile home or trailer roof structures, and more particularly, to a roof structure which may be readily added to and later readily removed from a mobile home, and which is easy and economical to fabricate and install. The added structure will protect a mobile home from the ravages of moisture, heat, snow and ice, and it allows a mobile home to be effectively insulated so as to markedly reduce heat conduction and conserve heating fuel and electrical energy used for air conditioning. The structure may be sturdily affixed to a mobile home without substantial alteration of the existing mobile home, so that no appreciable changes need be made to the basic structure of the mobile home when the removable roof structure of the invention is added or removed. A further advantage of the novel roof structure is that it is readily variable in length, so that it may be expanded or contracted and used on trailer homes of different lengths.

The principal attraction of mobile homes to many buyers is their low cost in comparison to that of conventional fixed-site dwellings. The mobility of a mobile home allows it to be used at a less expensive site than a building lot of the type at which permanent dwellings are usually erected, and allows economies in fabrication through the use of efficient factory techniques. However, such advantages tend to be offset by various disadvantages, which use of the present invention will at least in part alleviate.

Most mobile homes constructed in the last decade employ much sheet-metal fabrication, to minimize weight and enhance mobility by use of aluminum sheet, for example. While the extensive use of sheet metal construction afforded production economies and advantageously decreased the weight of mobile homes, much heat transfer occurs through the roof and walls of such homes because sheet metal has high thermal conductivity. Most existing mobile homes were constructed during an era of energy abundance, so that insufficient insulation was provided to allow the economical heating and cooling now demanded by the current and future energy crisis. Furthermore, the constructional techniques which have been used for most mobile homes precludes later installation of ceiling insulation, unlike ordinary dwellings, wherein access to an attic space ordinarily will allow one to add ceiling insulation at will. Moisture also tends to condense on metal panels. Most existing mobile homes employ roofs formed from plural side by side metal sheets, with edges of adjacent sheets bent to interlock in an attempt to provide watertight roof seams. While such roof seams may be adequately watertight when first fabricated, they often begin to leak after a trailer home has been used only a short time, probably, it is believed, because of the expansion and contraction of metal parts due to temperature changes, and because movement of a mobile home along a highway tends to apply stresses to such seams. Such leakage frequently causes wood and others members to rot. Caulking trailer roof seams on the outside of the trailer is not a satisfactory solution, because effective and permanent caulking compounds are unavailable, because the use of such caulking tends to be unsightly, and because a substantial amount of water may leak through a caulked seam before the fact that it is leaking can be discovered. Once appreciable moisture seeps through a leaking roof seam and rot begins to occur, it is extremely difficult to repair or replace any rotting members, since they tend to be not accessible, from either the inside or the outside of the trailer. In many existing trailer homes, leakage frequently occurs in the joints between the roof and the side walls as well as in the roof seams. The damage caused by leakage is further accentuated because moisture accumulates in areas which are not ventilated, and because sheet metal panels do not breathe to dispel moisture as wood and brick sections of an ordinary dwelling do.

In accordance with one aspect of the present invention, the heat or cooling losses which occur from a mobile home are markedly reduced by provision of an added, removable roof structure. Insulation material may be installed between the existing trailer roof and the added structure so as to greatly reduce heat and cooling losses, and even in the absence of insulation material, the air situated between the existing trailer roof and the added roof structure decreases heat and cooling losses. The removable roof structure of the present invention may be easily installed atop the trailer home when the home is already located at a chosen site, such as in a trailer park. Then even though the added roof structure itself incorporates interlocked sheet metal panels, because the added roof structure may be installed at the then "permanent" site of the trailer home, it need not be subject to the leak-causing stresses which would tend to occur were it pre-assembled at a factory and transported in assembled form along a highway.

In accordance with another aspect of the present invention, the damaging leakage of moisture at the roof seams and wall-to-roof joints is prevented, thereby eliminating the problem of rot. Even if the added roof structure should itself begin to leak, which could occur after extremely long usage, the air between the existing or original trailer roof and the added roof structure acts as a miniature attic space, which, importantly, is ventilated, so that moisture will be expelled therefrom.

A further advantage of the present invention is that installation of the added roof structure atop an existing trailer home is aesthetically pleasing, giving the trailer home more of the appearance of an ordinary permanent dwelling. As well as protecting the roof per se of the existing trailer, the removable roof structure of the present invention provides a substantial overhang, shading windows from the sun and further decreasing cooling losses, and protecting windows from rain and sleet, thereby decreasing heat loss and leakage around window joints.

An extremely important feature of the present invention is that installation of the added roof structure requires no alteration of the basic original structure of the trailer, and the provision of a removable roof structure of that type is an important object of the present invention. Since owners of mobile homes often live a transient type of life, by design or otherwise, it is vitally important that the added roof structure be removable. In accordance with the principles of the present invention, because the added roof structure is readily removable, it may be provided with sufficient size to provide substantial overhang, even though a usual trailer having that amount of overhang might not be legally transportable along a highway, or too large to negotiate various tunnels, underpasses, etc. In accordance with further principles of the invention, even though the added roof structure must be strong, and fixedly and securely attachable to the existing trailer so as to withstand strong wind and snow loads, removal of the roof structure does not leave any substantial amount of repair work to restore the trailer to substantially its original condition, and another important object of the invention is to provide a removable roof superstructure mounting arrangement of that type. In accordance with the invention, a pair of extruded strips are permanently mounted to extend horizontally along the sides of the trailer, so that the strips support substantially the entire weight of the added roof structure, so that the strips support substantially the entire weight of the added roof structure, and when the balance of the added roof structure is removed, the strips remain along the sides of the trailer to function as decorative and protective strips, making it unnecessary to plug or otherwise repair numerous screw holes.

Because cost is an important factor in the marketing of most products to mobile home owners, it is important that the added roof structure be easy and economical to fabricate, and the present invention readily meets that objective of the use of available materials which may be easily fabricated, and installed by unskilled personnel, with no special tools or machinery being required. The parts required to provide the added roof may be readily cut to size either at the trailer site or a remote site, knowing only a few dimensions of the trailer upon which the roof structure is to be installed.

The invention accordingly comprises the features of construction, combination of elements, and arrangement of parts, which will be exemplified in the constructions hereinafter set forth, and the scope of the invention will be indicated in the claims.

For a fuller understanding of the nature and objects of the invention reference should be had to the following detailed description taken in connection with the accompanying drawings, in which.

Figure 1:
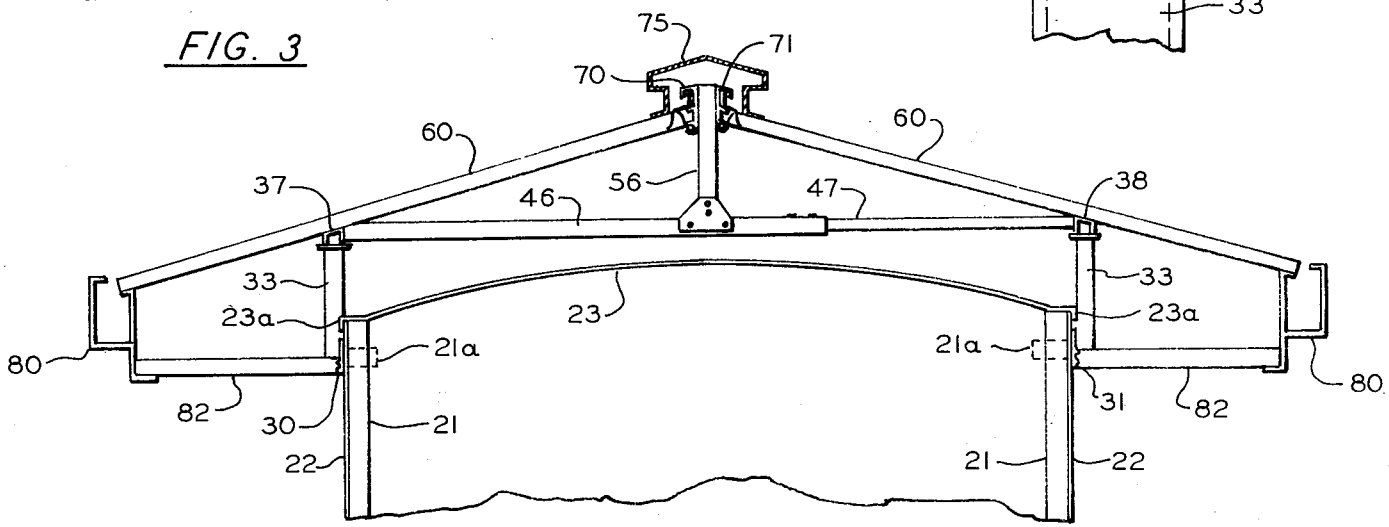
FIG. 1 is a cross-section end elevation view illustrating the basic structure of an exemplary form of the invention mounted atop a conventional mobile home, with various parts omitted for sake of clarity.

Referring now to the cross-section endwise elevation view of FIG. 1, portions of a conventional prior art mobile home are shown as including conventional vertical studding, such as wood studs 21, 21 spaced at intervals (typically 16 inches) along both sides of the structure, with outside sheet metal side panels 22, 22 affixed to the studs by means of screws (not shown). Some mobile homes use little or no vertical studding, but rather horizontally-extending longitudinal stringers, including ones such as those shown in phantom at

21*a*, 21*a* near the roof line. A conventional metal roof 23 comprises a domed sheet which extends entirely across the trailer, with ends 23*a*, 23*a* bent downwardly at the lateral extremities of the sheet. In practice single metal sheets are not available in large enough sizes to fabricate trailer roofs from a single sheet, so that a plurality of longitudinally spaced sheets are used, with the laterally-extending adjacent edges of the sheets interlocking. The difficulties of interlocking the edges of adjacent metal sheets so as to provide seams which remain watertight after substantial use and/or movement of the trailer are believed to be a principal cause of the failure of many trailer roofs. The inside of the trailer may be finished in a variety of ways, such as by nailing wood paneling to the studs, but since the inside construction of the trailer forms no part of the present invention inside constructional details are not shown in FIG. 1. The portions of FIG. 1 not yet mentioned all comprise an exemplary form of removable roof structure and now will be described. The entire removable roof structure may be attached to the existing previously-described trailer substantially solely by means of two extrusion strips 30, 31 which extend along the sides of the trailer, and the few changes or alterations which need be made in the existing trailer in order to mount the added roof structure is an important feature of the invention.

Figure 2:
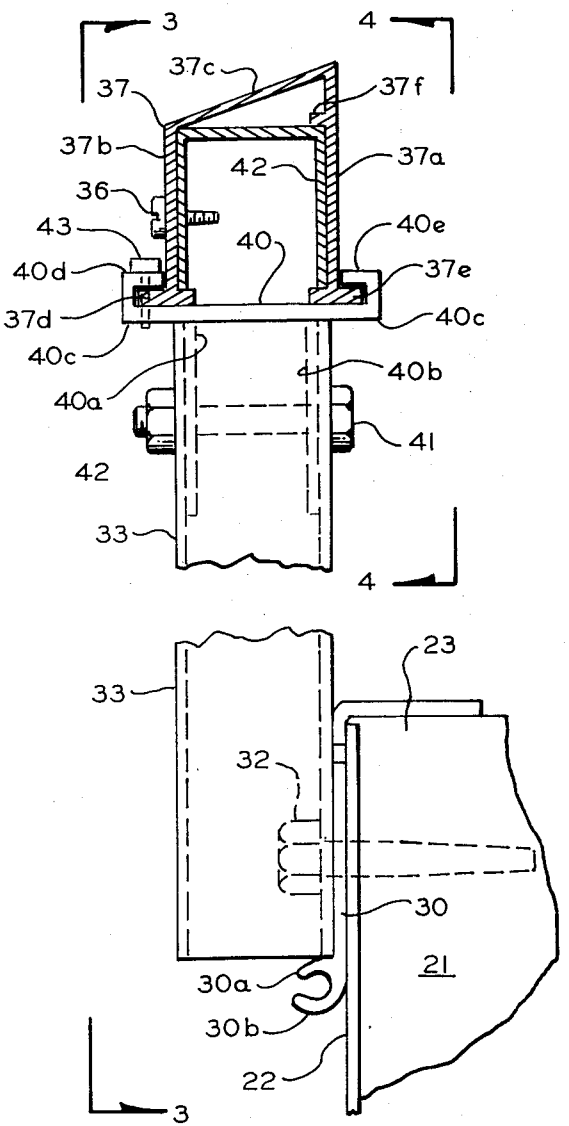
FIG. 2 is an enlarged view of a portion of FIG. 1.

A pair of supporting strips 30, 31 are installed along the sides of the trailer just below the roof line, preferably being held by screws. In FIG. 2 strip 30 is shown as comprising an aluminum extrusion having a cross-section readily discernible in FIG. 2, including a pair of lower flanges 30*a*, 30*b*. Strip 30 is shown affixed to a wood stud 21 by means of wood screw 32, which passes through a hole in tube 33 and through a hole drilled in existing side sheet 22. Strip 30 can, of course, be screwed to a horizontal stringer 21*a* in cases where the trailer is provided with such a stringer. Extrusions 30, 31 are thus fastened to the sides of the trailer in a manner which may be deemed permanent in the sense that strips 30, 31 are intended to remain on the sides of the trailer even if the added roof structure is later removed. When the added roof structure is removed strips 30, 31 act as decorative strips, and they tend to convey some water drainage to one end or the other of the trailer, depending upon the trailer slope, helping to keep the trailer windows clear of water draining from the roof. The fact that no basic changes need be made to the structure of an existing trailer to mount the added roof structure, and the fact that no extensive "repair" work need be done if the added roof structure is removed, are important features of the invention. While screw 32 in FIG. 2 is shown passing through only the inner wall of tube 33, a longer screw can, of course, be provided to extend through both walls of tube 33.

Figure 3:
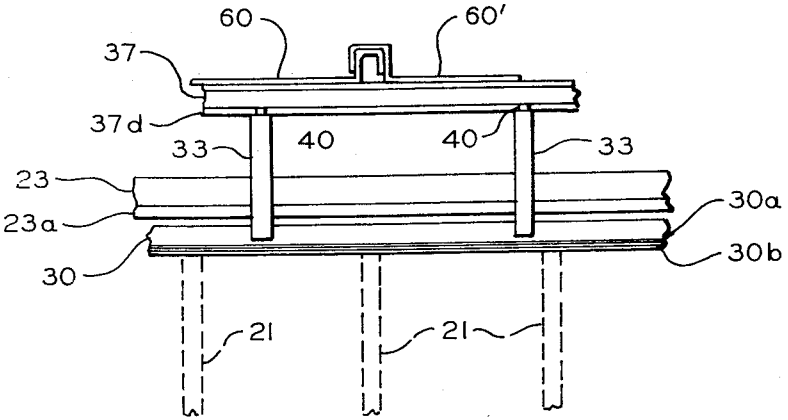
FIG. 3 is a view taken at lines 3—3 in FIG. 2.

As seen in FIG. 2, the lower edge of tube 33 rests atop flange 30*a* and hence screw 32 holds tube 33 which extends vertically above the level of the existing trailer roof sheet 23. A plurality of pieces of tubing 33 which form vertical support posts are spaced along both sides of the trailer and screwed to respective studs or horizontal stringers in similar fashion, several such pieces being shown in FIG. 3. Each piece of tubing 33 preferably comprises a hollow, rectangular piece of aluminum tubing, with outside dimenions of approximately 1.5 × 1.5 inch, for example. The pieces of tubing 33 are spaced along the sides of the trailer in pairs, i.e., so that each piece of tubing on one side of the trailer lies laterally opposite a similar piece of tubing on the opposite side of the trailer. In a typical application pairs of tubes 33 will be spaced at 3 or 4 foot intervals along the length of the trailer. Even though each piece of tubing is bolted to a given stud, the fact that the lower ends of these tubes rest on the upper flanges of strips 30 and 31 serves to distribute the load among the many studs spaced along the length of the trailer, since strips 30 and 31 are screwed to many studs in addition to those to which support posts 33, 33 are screwed.

Figure 4:
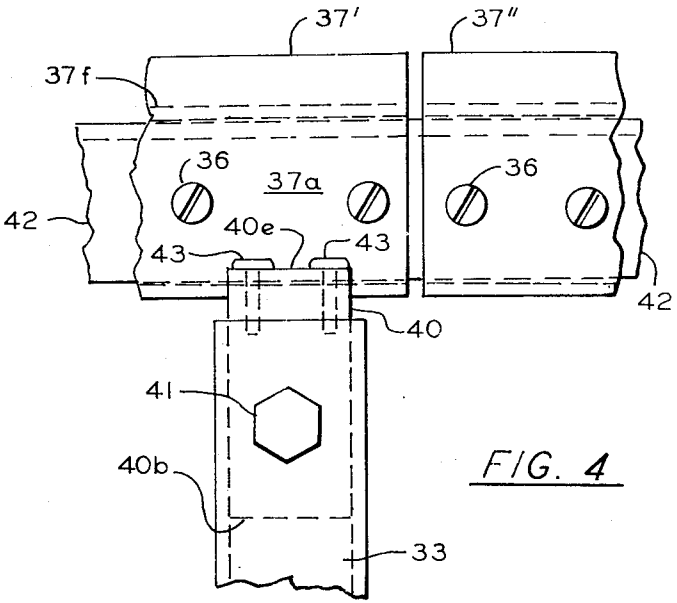
FIG. 4 is a view taken at lines 4—4 in FIG. 2.

As best seen in FIG. 1, a pair of roof-supporting aluminum extrusions 37, 38 extend horizontally and longitudinally along the sides of the trailer, each being attached to the tops of the row of tubes 33 spaced along one side of trailer in a manner made clear by reference to FIGS. 2 and 4. A piece of aluminum extrusion 40 is shown as including a pair of legs 40*a*, 40*b* which extend into the top of hollow tube 33 and a widened base portion 40*c* which seats atop the upper end of tube 33, with the base portion including a pair of turned-in flanges 40*d*, 40*e*. Means shown as comprising bolt 41 and nut 42 affix piece 40 to tube 33. Roof-supporting aluminum extrusion 37 is shown as comprising a generally channel-shaped section having one leg 37*a* longer than the other leg 37*b* so that web portion 37*c* extends at a slope preferably approximating the desired pitch of the roof structure to be added. Extrusion 37 also includes a pair of flange portions 37*d*, 37*e* at the extremities of its leg portions and an inner flange of the nature shown at 37*f*. If extrusion 37 is procured and used in lengths (e.g. 10 feet) less than the overall length of the added roof structure, several pieces of such extrusion may be placed end to end, to be coupled by channel pieces 42 to be described. In FIG. 4 two ends of adjacent pieces of extrusion 37 are shown at 37′ and 37″. In practice the joints between abutting pieces of extrusion 37 (and abutting pieces of similar extrusion 38) are substantially displaced longitudinally from the location of any post 33, and the joint is shown near post 33 in FIG. 4 solely for sake of drafting convenience. With a plurality of pieces 40 affixed to the tops of the tubes 33 spaced along one side of the trailer, and with the flanges 37*d*, 37*e* of end-to-end pieces of extrusion 37 situated beneath and captured by the flanges 40*d*, 40*e* of each piece 40, short lengths (e.g. 6 inches) of aluminum channel 42 then may be slid horizontally into extrusion 37 to couple adjacent ends of the pieces of extrusion 37, with the ends of pieces of extrusion 37 screwed to pieces of channel 42 as shown by screw 36. The insertion of pieces of channel 42 into the pieces of extrusion 37 also serves to lock flanges 37*d*, 37*e* beneath the in-turned flanges 40*d*, 40*e* of each piece 40. In order to prevent longitudinal movement of extrusions 37 within the track formed by flanges 40*d*, 40*e* of the mounting pieces 40, screws or pins are provided to extend through mating holes in flanges 40*d*, 37*d* and base 40*c* as shown at 43, 43 in FIGS. 2 and 4. One may note that when the added roof structure of the invention is to be removed, much of it may be removed by merely removing screws or pins 43 and then sliding extrusions 37, 38 longitudinally.

Figure 5:
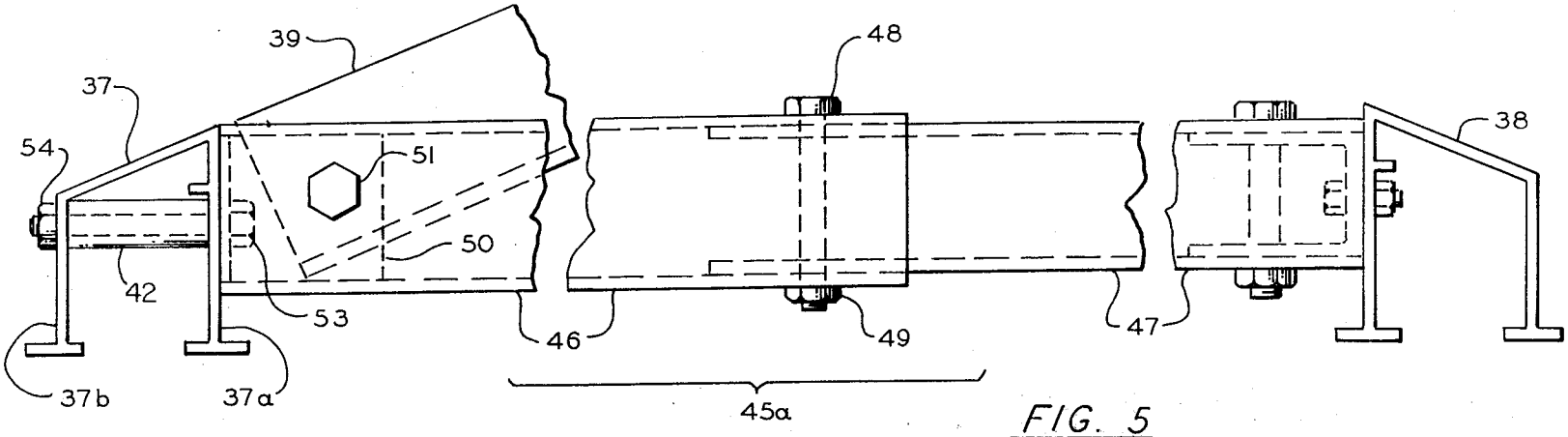
FIG. 5 is an enlarged view of a portion of FIG. 1.

In order to further stiffen the added roof assembly, a plurality of lateral bracket means 45*a*, 45*b*, etc., spaced at different longitudinal positions along the trailer extend laterally across the top of the trailer, each lateral bracket means connected to extrusion 37 on one side of the trailer, and to extrusion 38 on the other side of the trailer, in a manner which may be seen generally in FIG. 1 and with more detail in FIG. 5. The lateral bracket means may be longitudinally registered with support posts 33, but in no sense need to be, and they may be staggered longitudinally relative to the support posts. Further, it is not necessary that the numbers of lateral brackets equal the number of pairs of support posts. Lateral bracket 45*a* is shown as comprising a pair of telescoping tubular aluminum sections 46, 47 fastened together by means shown as comprising bolt 48 and nut 49. A short piece of channel section 50 is fitted into the end of tube 46 and held in place by bolt 51 and a nut, which bolt 51 passing through holes drilled in tube 46, the legs of channel piece 50, and one flange of brace 39, which is formed of aluminum angle. Bolt 53 passes through a hole in the web portion of channel piece 50, a hole in leg portion 37*a* of extrusion 37, through a short length of hollow round aluminum tubing 52 which acts as a spacer between flanges 37*a*, 37*b*, and through a hole in flange 37*b*, and with nut 54 bolt 53 will be seen to hold tube 46 of lateral bracket means 45*a* rigidly to extrusion 37. The outer end of tube 47 is shown attached to extrusion 38 in similar manner.

Figure 8:
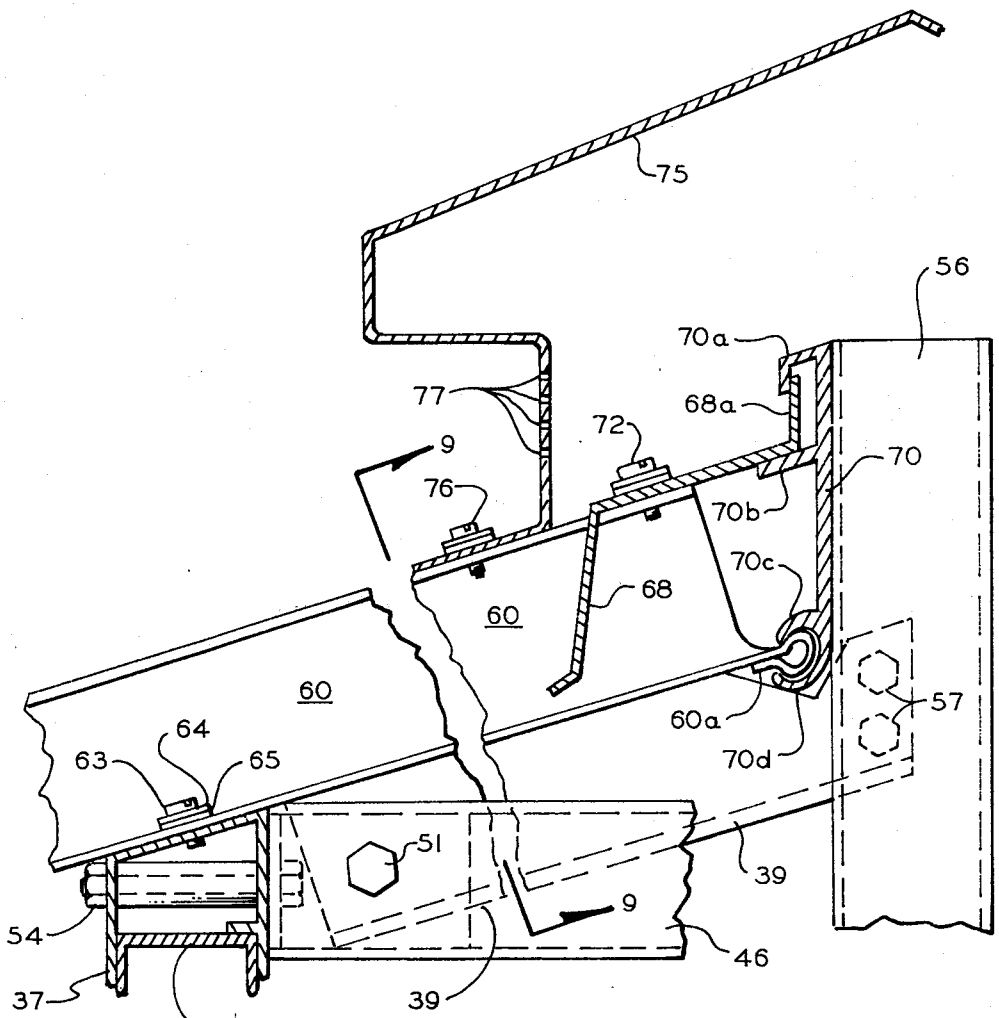
FIG. 8 is an enlarged view of a portion of FIG. 1.
Figure 10:
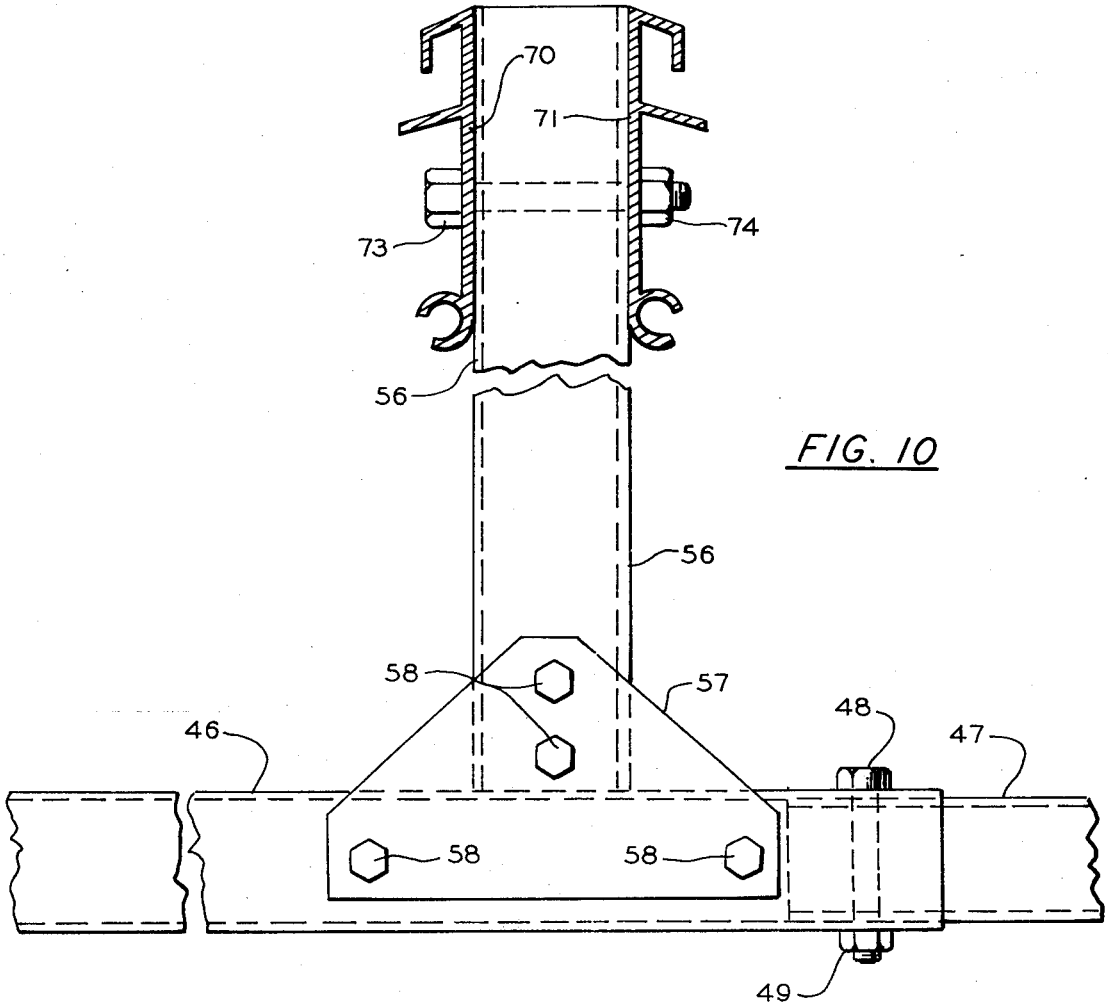
FIG. 10 is an enlarged view of a portion of FIG. 1.

To provide further rigidity and roof support, lengths of aluminum angle 39 slope upwardly from each extrusion 37 lateral bracket 46 tie point or joint to a respective vertical post 56. As will be seen below, angles 39 serve to support roof panels, as well as stiffening the structure. In FIG. 8 the vertical flange of angle 39 is shown cutaway to clear the lower flange 70*d* of an extrusion 70 and shown bolted to vertical post 56 by bolts 57, 57. If desired, angle 39 may be rotated from the position shown so that its horizontal sloping flange lies against the bottom of a roof panel 60, and the roof panel 60 can be screwed to angle 39. In many applications, however, angles 39 need not furnish support for the roof panels 60, and the inner end of angle 39 can be bolted to post 56 at a slightly lower location than that shown in FIG. 8, thereby avoiding any need to notch that end of angle 39 to clear the lower flanges of extrusion strip 70. A plurality of vertical tube pieces 56 extend upwardly from respective ones of the lateral bracket means (e.g. 46) to carry a pair of ridge pole extrusions 70, 71. In FIG. 10 a rectangular tube 56 is shown seated atop and bolted to section 46 of lateral stiffener 45*a* by means shown as comprising a generally triangular gusset plate 57 and bolts 58, 58 held by nuts (not shown). Ridgepole extrusions 70, 71, the cross-section of which are evident from FIG. 10, are bolted to riser tube 56 by bolt 73 and nut 74, and similarly bolted to further similar risers which extend upwardly from similar lateral bracket assemblies 45 spaced apart along the length of the trailer.

Figure 7:
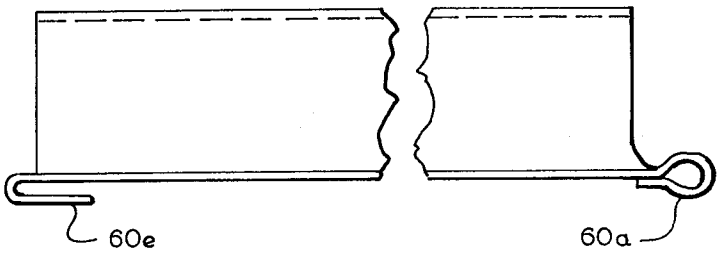
FIG. 7 is a view taken at lines 7—7 in FIG. 6.
Figure 6:
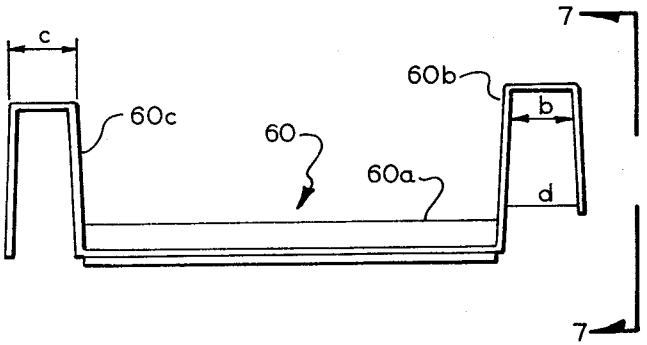
FIG. 6 is an end view of a sheet-metal roof panel which may be used with the invention.

The outer roof of the novel added roof structure preferably comprises a plurality of aluminum or other sheet metal or fiberglass panels which interlock in a manner to be described. One such panel 60 is illustrated in FIGS. 6 and 7 as comprising a sheet having a rolled edge portion 60*a* along one of its sides, a folded edge as shown at 60*e* along the opposite side, and two generally channel-shaped stiffener ridges formed along the two remaining sides. One stiffener ridge 60*b* preferably has slightly different dimensions than the other stiffener ridge 60*c*. For example, the inside dimension *b* of ridge 60*b* preferably approximates the outside dimension *c* of ridge 60*c*, thereby allowing the smaller ridge of one such panel to snugly fit inside the larger ridge of an adjacent panel, thereby providing an overlapping of the edges of adjacent panels in a watertight manner. The ridges are also preferably slightly trapezoidal in cross-section, e.g. dimension *b* is slightly less than dimension *d* in FIG. 6.

Figure 9:
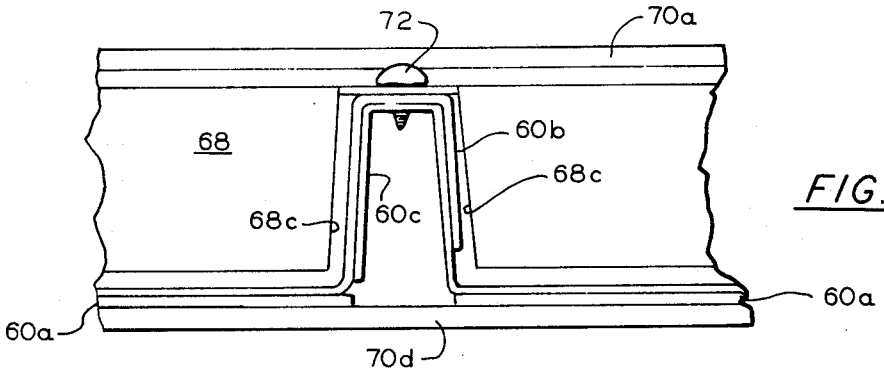
FIG. 9 is a view taken at lines 9—9 in FIG. 8.

Panels of the nature shown in FIGS. 6 and 7 are mounted to form the added trailer roof in a manner shown in FIGS. 1, 8 and 9. The rolled edge 60*a* of each roof panel slidingly fits in the arcuate track formed by the curved lower flanges e.g. 70*c*, 70*d*, of one of the ridgepole extrusions 70 or 71. The stiffener ridges of the roof panels then slope laterally toward one side or the other of the trailer. In FIG. 9 the larger stiffener ridge 60*b* of one roof panel 60 is shown covering the smaller stiffener ridge 60*c* of an adjacent roof panel. At one or more places where each roof panel crosses one or the other of the roof supporting extrusions 37 and 38, the panel is screwed to the sloping web portion (37*c* or 38*c*) of the roof support extrusion, by means shown in FIG. 8 as comprising a sheet-metal screw 63, a flat washer 64, and a rubber grommet 65.

In order to more effectively cover the area adjacent the ridgepole extrusions where stiffener ridges of adjacent roof panels overlap, a notched strip 68 bent to the cross-section shape shown in FIG. 8 is mounted as shown, with its upper flange 68*a* captured between upper flanges 70*a*, 70*b* of ridgepole extrusion 70 and its mid portions screwed to a superimposed pair of stiffener ridges by means shown as screw 72 in FIG. 8. Strip 68 is provided with notched portions of the nature shown at 68*c* in FIG. 9, adjacent each overlapping pair of roof panel stiffener ridges. Preferably covering the entire ridgepole area of the roof structure along the entire length of the trailer is a ventilating ridge cap-like extrusion of formed metal 75 having a shape made evident in FIG. 8, with the lower flanges of the cap 75 screwed to roof panel stiffener ridges as shown at 76. A plurality of holes 77, 77 in a vertical side portion of the cap admit ventilation.

Figure 11:
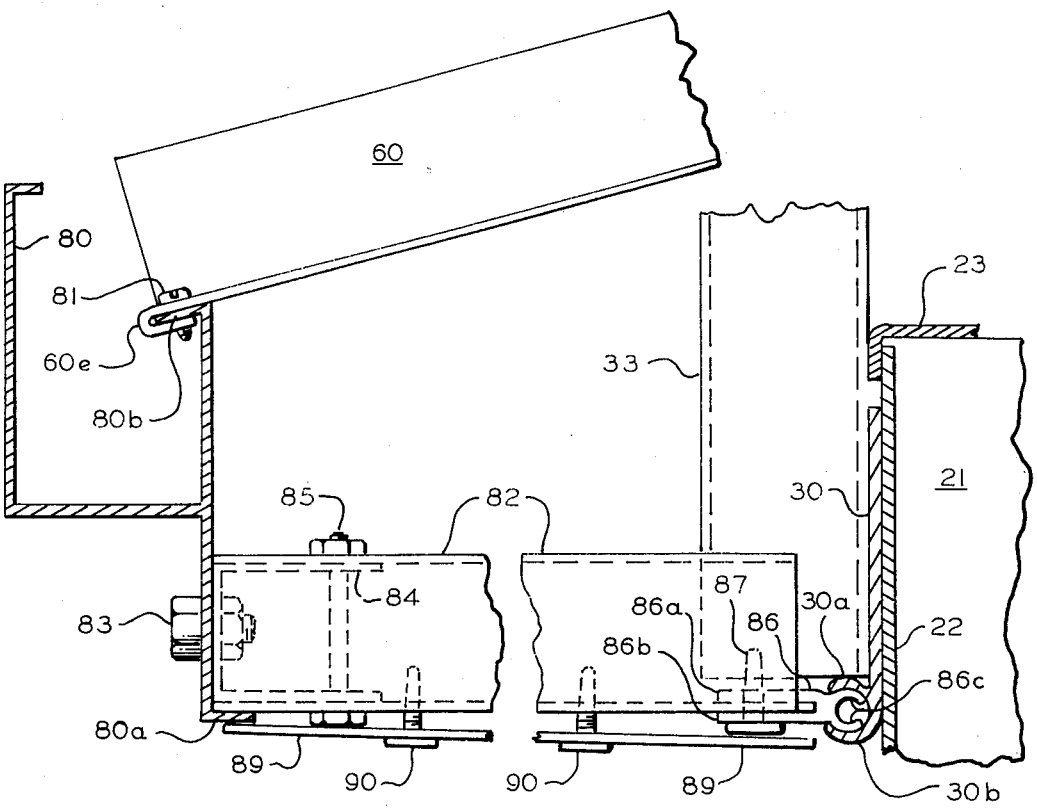
FIG. 11 is an enlarged view of a portion of FIG. 1.

As is evident in FIG. 8, the roof panels 60 slope outwardly beyond the side extrusions 37, 38, and as is shown in FIG. 11, the outer flange 60*e* of each roof panel 60 surrounds flange 80*b* of an eavestrough formed by an eavestrough extrusion 80, panel 60 being shown attached to extrusion 80 by means of screw 81 in FIG. 11. Spaced at desired longitudinal intervals along each side of the trailer are a plurality of horizontal laterally-extending sections of rectangular tubing, one of which is shown at 82 in FIG. 11, and which sections of tubing comprise soffit brackets. Brackets 82 will be seen together with the roof panels, to hold the eavestrough extrusions erect. The outer end of bracket 82 rests on lower flange 80*a* of extrusion 80, and is securely fastened to extrusion 80 by bolt 83, which bolts to a short length of channel 84 fitted inside tube 82 and bolted to tube 82 by means of bolt 85. The inner end of soffit bracket 82 is shown affixed to side extrusion 30 by means of a clip 86, a short length of aluminum extrusion having a cross-section evident from FIG. 11. The lower side of tube 82 fits between the two leftwardly extending legs 86*a*, 86*b* of clip 86 and is affixed thereto by screw 87. The right-side edges of clip 86 form a rounded loop 86*c* which slidingly fits between the flanges 30*a*, 30*b* of extrusion 30. After the soffit brackets 82 have been mounted, a perforated soffit material shown as comprising aluminum sheet 89 is mounted to extend along the area between the bracket 82 and screwed thereto as by means of screws 90, 90.

Figure 12:
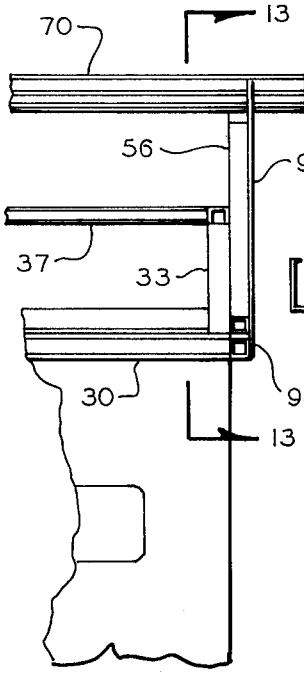
FIG. 12 is a side elevation view of portions of the added roof structure.
Figure 13:
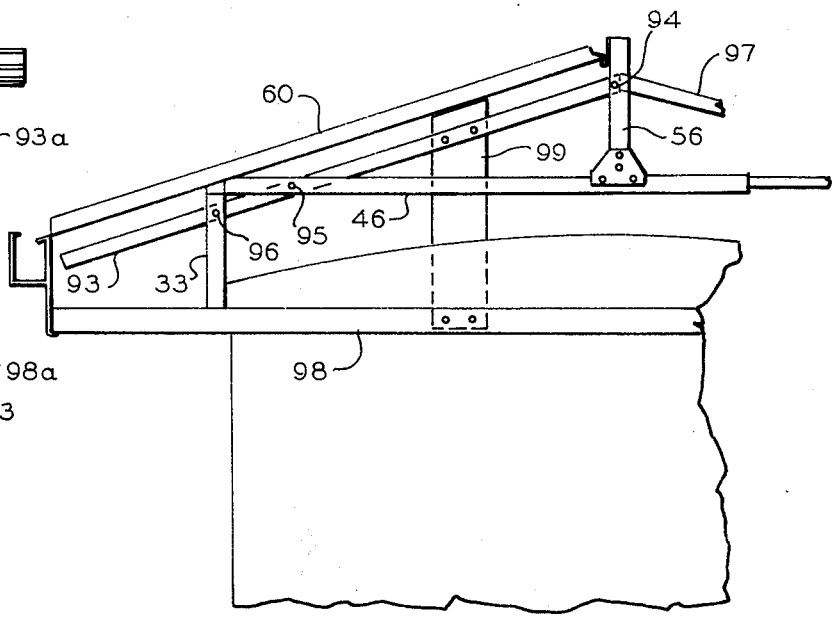
FIG. 13 is a view taken at lines 13, 13 in FIG. 12.

The preferred manner in which the ends of the added roof structure are finished will become evident from a consideration of FIGS. 12 and 13. A pair of vertical standards or posts 33 project upwardly from the extrusions 30, 31 near each end of the trailer, and thus a centerpost 56 extends upwardly from the transverse horizontal member 45 interconnecting the posts 33. A length of hollow rectangular tubing 93 is bolted to post 56 and 94, to cross-member 46 at 95, and to the end post 33 at 96, and slopes downwardly and outwardly to near eavestrough 80. Tube 93 is preferably mounted as far upwardly as possible on tubes 33 and 56, so as to lie on a short distance below the end of roof panel 60. Another piece of similar tubing 97 is mounted to slope in similar fashion in the opposite direction from post 56. A further piece of hollow rectangular tubing 98 is fastened to the end wall of the trailer, as by means of lag screws (not shown). The end posts 33 are located longitudinally as shown in FIG. 12 so that the outer faces (e.g. 93*a*) of tubes 93 and 97 are longitudinally aligned with the outer face 98*a* of tube 98. The outer faces of tubes 93, 97 and 98 thus define a plane in which sheets of aluminum siding may be mounted to cover the end of the roof structure. In FIG. 13 one section of aluminum siding 99 is shown screwed to members 93 and 98. The vertical edges of the strips of siding 99 are preferably folded so that edges of adjacent sheets interlock. As well as serving as support brackets for strips of siding 99, tubes 93 and 97 add rigidity to the endmost truss structures, making it unnecessary that braces of the type shown at 39 in FIGS. 5 and 8 be used adjacent the endmost posts 33. While tube 98 has been indicated as being fastened to the end wall of the trailer by screws, so that screw holes will remain when the added roof structure and tube 98 is removed, the screws used to fasten tube 98 to the trailer end wall need only be small screws, since tube 98 need not bear any appreciable portion of the weight of the added roof structure, and when tube 98 is removed, small screws may be inserted in the remaining holes to plug them.

It will be apparent in FIG. 1 that one or more layers of any one of a number of common forms of insulating material (now shown) such as glasswool mats or various forms of blown plastic insulation may be laid atop existing roof 23. Also, by merely removing one or several end panels (of the type shown at 99 in FIG. 13), it will be apparent that the insulation may be changed or added. Downspouts (not shown) are connected to eavestroughs 80, 80 in conventional fashion.

In some applications of the invention, such as installations expected to incur very heavy wind loads, side strips 30, 31 may be eliminated, and some or all of posts 33 greatly elongated so that they extend down to be anchored in the ground, and are bolted to vertical studs at several points along their lengths. Then, of course, all of the weight of the added roof structure will be transmitted by the posts 33 directly to the ground, and the posts 33 may be affixed to the vertical studs using very small screws.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

1. An added roof structure for use on a house trailer having an existing sheet-metal roof, comprising, in combination: a first plurality of vertically-extending support posts spaced apart from each other along a first side of said trailer and fixedly mounted against said side of said trailer; a second plurality of vertically-extending rigid support posts spaced apart from each other along a second side of said trailer and mounted against said second side of said trailer, each of said support posts extending from a level below said existing sheet-metal roof to a level above said existing sheet-metal roof; a first longitudinally-extending strip means fastened to and interconnecting the upper ends of said support posts of said first plurality; a second longitudinally-extending strip means fastened to and interconnecting the upper ends of said support posts of said second plurality; a plurality of rigid laterally-extending support bracket means each extending between and attached to said first and second longitudinally-extending strip means to prevent lateral relative movement between said first and second longitudinally-extending strip means; a third plurality of rigid support posts each affixed to and extending upwardly from a respective one of said laterally-extending support bracket means; third longitudinally-extending strip means affixed to an interconnecting said third plurality of support posts adjacent their upper ends; a first plurality of mutually-interlocking roof sheet means each supported by said third strip means and said first strip means; a second plurality of mutually-interlocking roof sheet means each supported by said third strip means and said second strip means; a first member fixed to and extending from one of said support posts of said third plurality adjacent an end of said trailer downwardly and laterally outwardly beyond one of said support posts of said first plurality adjacent said end of said trailer and being connected to said one of said support posts of said first plurality; a second member extending laterally across and affixed to said end of said trailer at a level below said existing roof; and a plurality of metal sheets each connected to said first and second members.

2. A removable added roof structure for use on a trailer having an existing roof, comprising, in combination: a first plurality of vertically-extending rigid support posts spaced apart from each other along a first side of said trailer and mounted against said first side of said trailer; a second plurality of vertically-extending rigid support posts spaced apart from each other along a second side of said trailer and mounted against said second side of said trailer, each of said support posts extending to a level above said existing roof; a first longitudinally-extending strip means fastened to and interconnecting the upper ends of said first plurality of support posts; a second longitudinally-extending strip means fastened to and interconnecting the upper ends of said second plurality of support posts; a plurality of laterally-extending support bracket means each extending between said first and second longitudinally-extending strip means; a third plurality of rigid support posts each affixed to and extending upwardly from a respective one of said laterally-extending support bracket means; third longitudinally-extending rigid strip means affixed to and interconnecting said third plurality of support posts adjacent their upper ends; a first plurality of roof sheet means each supported at one end by said third strip means, extending downwardly and laterally outwardly beyond said first strip means, and being supported by said first strip means; a second plurality of roof sheet means each supported at one end by said third strip means, extending downwardly and laterally outwardly beyond said second strip means and being supported by said second strip means; a first member fixed to and extending from one of said support posts of said third plurality adjacent an end of said trailer downwardly and laterally outwardly beyond one of said support posts of said first plurality adjacent said end of said trailer and being connected to said one of said support posts of said first plurality; a second member extending laterally across and affixed to said end of said trailer at a level below said existing roof; and a plurality of metal sheets each connected to said first and second members.

3. A structure according to claim 2 having metal sheet means situated above and covering said third strip means, one edge of said metal sheet means lying atop and being fastened to said first plurality of roof sheet means, and an opposite edge of said metal sheet means lying atop and being fastened to said second plurality of roof sheet means.

4. A structure according to claim 3 wherein said third strip means comprises a pair of strips fastened to said third plurality of support posts on mutually opposite sides of said support posts of said third plurality.

5. A structure according to claim 3 having fourth and fifth strip means fastened against and extending along said first and second sides, respectively, of said trailer at a level below said existing roof, said first plurality of support posts being fastened to said fourth strip means and said second plurality of support posts being fastened to said fifth strip means and wherein said roof sheet means of said first plurality comprise a plurality of metal sheets, each of said metal sheets including at least first and second stiffener ridges, the first stiffener ridge of one of said metal sheets being nested within a stiffener ridge of a second one of said metal sheets, and a stiffener ridge of a third one of said metal sheets being nested within said second stiffener ridge of said one of said metal sheets.

6. A structure according to claim 3 having a generally channel-shaped eavestrough means extending between and fastened to the ends of said roof sheet means of said first plurality, fourth strip means mounted against and extending along said first side of said trailer at a level below that of said existing roof; a plurality of laterally-extending soffit support bracket extending between said eavestrough means and said fourth strip means; and perforated sheet metal soffit means fastened to said soffit support brackets.

7. A structure according to claim 3 wherein said first strip means includes flange means, and said structure includes a plurality of attachment means for fastening said first strip means to the upper end of said first plurality of support posts, each of said attachment means comprising a bracket secured to a respective one of said support posts of said first plurality and having a pair of inwardly-extending flanges surrounding portions of said flange means of said first strip means.

8. A structure according to claim 3 wherein said first strip means comprises a plurality of lengths of metal channels arranged end-to-end substantially abutting each other, and a respective further channel nested within and extending between each adjacent pair of ends of said end-to-end channels.

9. A structure according to claim 3 wherein said first strip means comprises an elongated metal member having a generally channel-shaped cross-section including first and second leg portions of differing heights interconnected by a web portion, said leg portions extending vertically and said web portion sloping at substantially the same pitch as said roof sheet means of said first plurality.

* * * * *